United States Patent [19]

Roth

[11] Patent Number: 4,598,904

[45] Date of Patent: Jul. 8, 1986

[54] WATER TRAMPOLINE

[75] Inventor: Erland Roth, Altenstadt, Fed. Rep. of Germany

[73] Assignee: Corvinus & Roth GmbH, Altenstadt, Fed. Rep. of Germany

[21] Appl. No.: 662,672

[22] Filed: Oct. 19, 1984

[30] Foreign Application Priority Data

Oct. 10, 1984 [DE] Fed. Rep. of Germany ... 8429851[U]

[51] Int. Cl.[4] ..... A63B 5/18

[52] U.S. Cl. ..... 272/65; 272/1 B; 441/39

[58] Field of Search ..... 272/65, 66, 1 B, 1 E; 441/39; D21/236, 237

[56] References Cited

U.S. PATENT DOCUMENTS

| | | | |
|---|---|---|---|
| 1,973,584 | 9/1934 | Tatter et al. | 441/39 |
| 2,888,690 | 6/1959 | Shaw | 441/39 |
| 2,914,779 | 12/1959 | Walker | 441/39 |
| 2,974,331 | 3/1961 | Dize | D21/237 X |
| 3,047,294 | 7/1962 | Maxwell | 272/65 |
| 3,983,585 | 10/1976 | Sidlinger | 272/65 X |
| 4,339,123 | 7/1982 | Rich | 272/65 |
| 4,386,772 | 6/1983 | Wu | 272/65 |

FOREIGN PATENT DOCUMENTS

| | | | |
|---|---|---|---|
| 602103 | 7/1960 | Canada | 441/39 |
| 107456 | 7/1917 | United Kingdom | 441/39 |

*Primary Examiner*—Robert E. Bagwill
*Assistant Examiner*—Arnold W. Kramer
*Attorney, Agent, or Firm*—Dennison, Meserole, Pollack & Scheiner

[57] ABSTRACT

A water trampoline includes a buoyant inflatable base formed from a plurality of individual buoyant chambers interconnected to define the support for the trampoline. A rigid support frame consisting of an assembled plurality of individual legs is removably attached to the upper surface of the buoyant base member and a jumping cover is resiliently attached to the frame to position the cover above the water on which the base is floating. A shock absorbing cover is positioned over a portion of the base and the frame together with the interconnecting resilient-matting to prevent user contact with these elements. A detachably connected cushioned platform is mounted to overlie a portion of the shock absorbing cover, the frame and the base in a stacked arrangement to provide an elongated takeoff area.

10 Claims, 5 Drawing Figures

WATER TRAMPOLINE

The invention relates to a water trampoline comprising a tube-like supporting body filled with gas as well as air which is defining a base frame, and a jumping covering like a jumping sheet, at least partially covering the interior of the base frame.

The German Utility Model Application DE-GM No. 728027 describes a water trampoline comprising a tubed tire made of rubber, being supported by a base plate made of synthetic material. Retaining bands are extending from the tubed tire, which are holding the jumping covering. The base plate is required to give the jumping covering like a jumping sheet the necessary prestress as the tubed tires do not have the required stability. Although such a trampoline is able to float, water cannot accumulate to a desired extent between the rubber tire and the base plate so that the jumping covering, when extending in direction to the bottom, will come into contact with the water whereby the jumping property is reduced. Further there is a risk of injury in the region between the jumping covering and the rubber tube, thus also the area of the elastic springs. Likewise there are transportation problems due to the base plate.

It is the object of the present invention to improve a water trampoline of the above mentioned kind in such a manner that the elastic property of the jumping covering cannot be negatively influenced by the water, that further a risk of injury is excluded and that there is a possibility to jump down on the jumping covering from different heights of the frame. Finally a problemless and space-saving transport of the trampoline shall be provided.

According to the innovation the object is realized in such a manner that a solid supporting frame for the jumping covering is arranged on the base frame; that at least the supporting frame and those areas of the jumping covering provided with fixing elements that lead to the supporting frame, are covered with at least one shock-absorbing element, and that the base frame at least in one section thereof has a raising extending over the supporting frame. Thereby the base frame is preferably of rectangular configuration with four chambers that can be separately inflated, where the supporting frame itself is detachably arranged on the upper surface of the base frame. In a preferred embodiment of the innovation the supporting frame being solid within itself can be made of square pipes that can be fitted into one another, which are fixed on the base frame by means of quick-action clamping fastenings. Thereby the quick-action clamping fastenings can be vulcanized onto the frame.

Because the jumping covering is mounted on a supporting frame of all solid structure it is guaranteed that even at a pressure effect on the jumping covering, the frame will keep up the geometry being required for the tension of the jumping sheet. Nevertheless the complete water trampoline can be transported taking up little space as the base frame itself after evacuation of the air can be folded up and the supporting frame can be disjoined into the four frame legs being joined by means of plug-in connections for making the frame.

In order to fix the jumping sheet on the supporting frame without any problems, this frame has wave-like fixtures preferably at its inner surfaces and extending along the same, in which fixtures the springs coming from the jumping sheet are nested.

In order to eliminate the risk of an injury that could occur by a landing in the area between the supporting frame and the jumping sheet, according to a further characteristic of the teaching of this innovation this area is covered by a shock-absorbing means, preferably being composed of a wedge-shaped matting enclosing the outside of the supporting frame and extending into the jumping sheet so far that the spring is not freely accessible anymore. Thereby the enclosing wedge-shaped matting that can also be composed of sections has its greatest thickness within the area of the supporting frame.

In order to make it possible that the jumping down onto the jumping sheet from different heights of the base frame, preferably one leg of the rectangular base frame has a platform defining the raising, which platform is realized by inflatable air cushions extending from the supporting frame. Preferably the platform is composed of two air cushions being arranged one on top of the other and joined e.g. by vulcanizing, of which the longitudinal extent is chosen in such a manner that there is a formation of steps in the front areas. In other words, the lower air cushion has a smaller longitudinal extent than the coordinated leg of the base frame on which the platform is arranged. The same applies to the air cushions being arranged one on top of the other.

In order to make it possible to ascent the water trampoline according to the innovation without any problems, it is suggested in still another embodiment that at least within the region of the platform handles and/or steps are arranged, e.g. by vulcanizing to the outer wall of the base frame. Thereby in the region of the handles and/or steps one can in addition provide a plate-shaped means starting from the base frame and extending into the water, on which a user of the trampoline will arrive first where he can find a hold in order to reach then the frame and/or the platform. Such an embodiment is advantageous since otherwise the climbing of the base frame would require considerable efforts.

A water trampoline according to the innovation can have a size of e.g. 5 m by 3.50 m, where the height of the base frame is approximately 80 cm and that of each of the platform cushions 40 cm. Consequently the free surface of the platform will be approx. 1.40 m to 1.50 m above the surface of the water. By the distance of approx. 0.80 cm between the surface of the platform and the jumping sheet there is especially offered the advantage that the jumping in on the trampoline is facilitated.

Finally according to still another embodiment the accessible surface of the air cushions defining the platform is structured in order to thus avoid a sliding-off.

Further details, advantages and characteristics of the innovation will result not only from the claims and the individual features of same but also from the following description of a preferred embodiment example as shown in the drawing, where FIG. 1 is a fragmentary top view of a detail of a water trampoline according to the invention;

Figure 1:
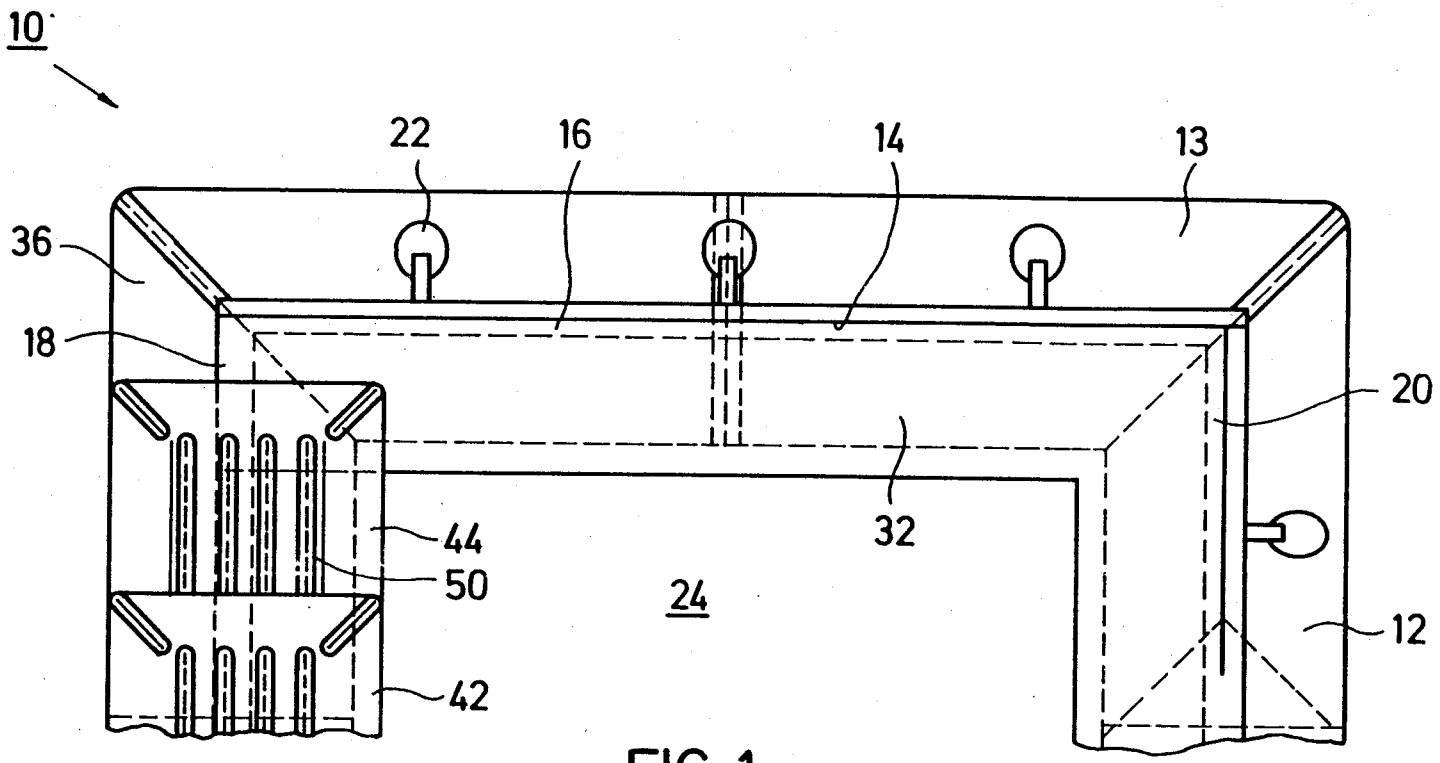

The water trampoline 10, shown in detail and in top view in FIG. 1, is composed of a tube-like base frame 12, on the upper surface 13 of which and preferably in the center area thereof is detachably arranged a supporting frame 14. Thereby the base frame 12, being of rectangular configuration, can be composed of four chambers, of which the bulkheads are running into the center area of the frame legs. The supporting frame 14 itself is made of square tubes pieced together by web joints that are mitered. The shown legs or, respectively, leg sections 16, 18, 20 are detachably connected with the supporting frame 12 by means of quick-action fixing means, one of which having the reference number 22, where the quick-clamping fixtures are vulcanized onto the tube-shaped base frame. Here the quick-clamping devices 22 not only guarantee that the supporting frame 14 is stationarily arranged on the base frame 12 but that eventually also an easy fixing or, respectively, detaching is possible so that a quick assembly or, respectively, demounting of the water trampoline 10 according to the innovation is provided. The inner surface of the supporting frame 14 and thus of the base frame 12 is covered by a jumping sheet 24 being connected to the frame legs 16, 18, 20 by means of springs 26 and 28. Thereby preferably at the insides of the legs a wave-like holding means 30 can be provided extending in longitudinal direction thereof, into which the springs 26, 28 for the jumping sheet 24 are put.

In order to prevent any free access from above to the steel frame 14, the holding means 30 as well as the springs 26, 28, which could give rise to a risk of injury, at least this area is covered by a shock-absorbing means 32, like a wedge-shaped matting made of plastic foam material. Here the thickness of the shock-absorbing means 32 is the strongest in the region of the supporting frame 16, 18, 20 and is decreasing to the jumping sheet 24. Further the shock-absorbing means 32 has a squared-off leg 34 enclosing the outer surface of the frame leg 16, 18, 20 so that in this manner the protecting matting 32 can be safely fixed without any additional fastening means.

At least on one leg (in the embodiment example on leg 36) of the base frame 12 and thus on the leg 18 of the steel frame 14, a platform 38 is arranged in order to provide a raised take-off area with respect to the surface of the frame 14. Here the platform (38) is composed of two air cushions 40, 42 being arranged one on top of the other and vulcanized together, of which the longitudinal extent, for forming the steps 44, 46, is different and less than the length of the leg 36. Hereby the accessible surface of each cushion 40, 42 can further have a structurization 50 in order to reduce the risk of slipping.

The lower air cushion 40 further preferably has a board-shaped holding means (not marked in detail), which is detachably connected to the leg 18 of the steel frame or, respectively holding frame 14.

Figure 2:
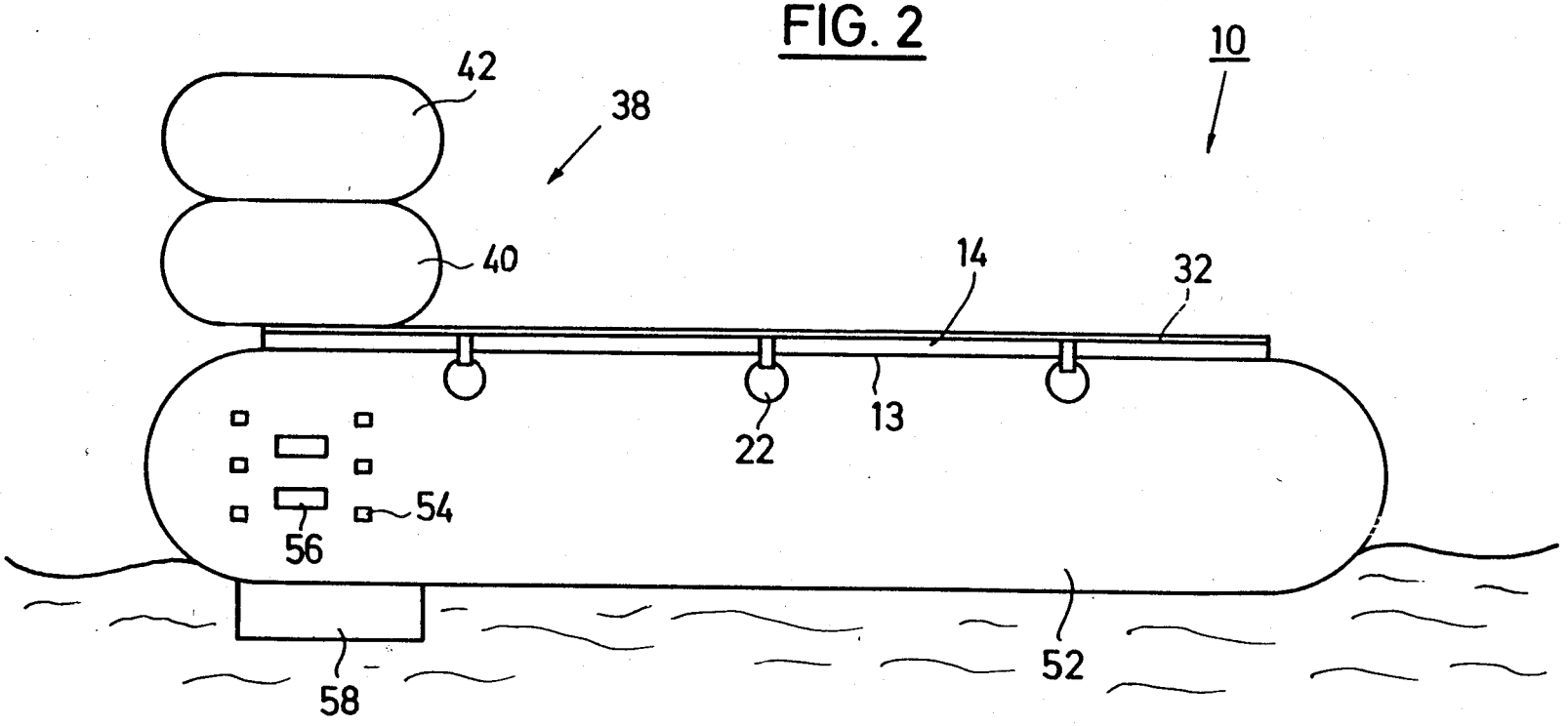
FIG. 2 is a side elevational view of the water trampoline.
Figure 3:
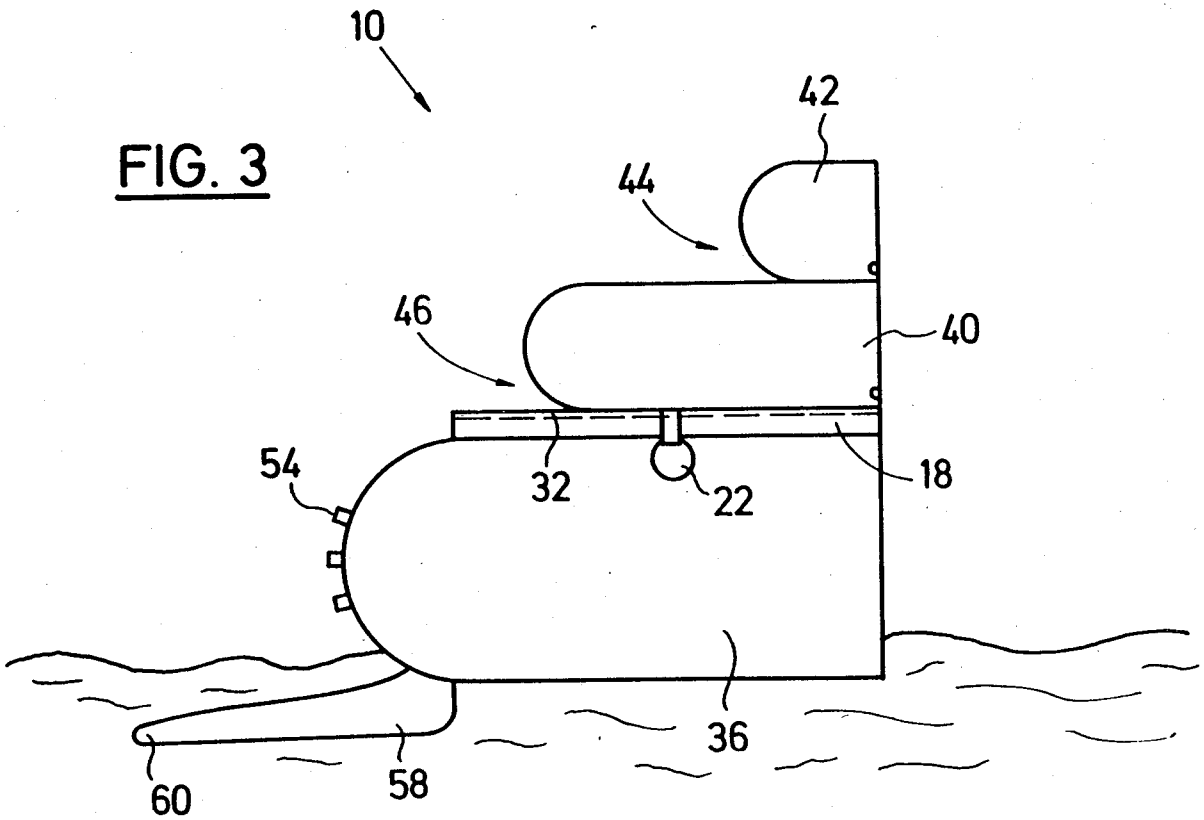
FIG. 3 is a fragmentary end view of the water trampoline illustrated in FIGS. 1 and 2.
Figure 4:
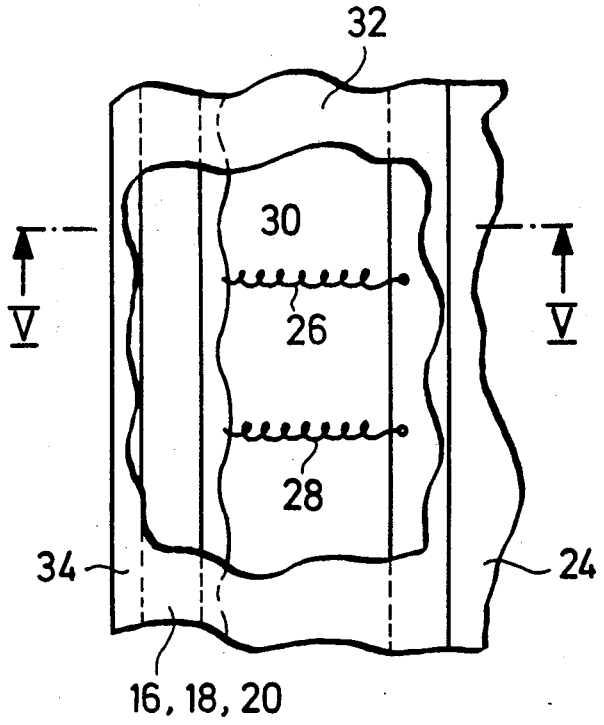
FIG. 4 is a fragmentary top view of a detail of the water trampoline illustrated in FIG. 1.
Figure 5:
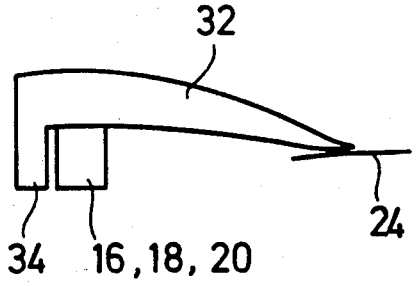
FIG. 5 is a sectional view along the line V—V in FIG. 4.

By the FIGS. 2 and 3 it shall further be explained that in the region of the platform 38 at least at one outer wall of the base frame 12 (in the embodiment example on the leg 52 not shown in FIG. 1) there are arranged holding means 54 or steps 56 in order thus to facilitate the ascending of the water trampoline 10.

In addition a plate-like means 58 can be provided being positioned in this area, extending from the bottom region of the base frame 12, i.e. in the embodiment example from the leg 52, into the water in order to thus offer a holding area for a swimmer from which he can climb up to the water trampoline 10. Hereby the holding means 58 is extending into the water like a ramp, therefore in the area of the leg 52 is of less height than at its free end 60 with respect to the water surface.

I claim:

1. A water trampoline comprising a buoyant inflatable base including a plurality of individual buoyant chambers interconnected to define said base, a support frame consisting of an assembled plurality of individual legs, attached to and mounted directly on said base, a jumping cover attached to said support frame to define a flexible sheet extending substantially over at least the inner perimeter of said frame and supportingly secured thereto at spaced positions around said frame by a plurality of resilient elements; shock absorbing cover means overlying said frame and the periphery of said jumping cover to prevent contact between a user and said frame and said resilient elements supporting said jumping cover thereon, and a detachably connected raised cushioned platform positioned to overlie a portion of said shock absorbing cover and a portion of said support frame and a portion of said inflatable base in stacked array to provide an elevated takeoff area.

2. A water trampoline according to claim 1 wherein the base (12) is a rectangular shape with four chambers separately inflatable and the supporting frame (14) is detachably positioned on the upper surface (13) of the base.

3. A water trampoline according to claim 1 wherein the support frame (14) is a frame composed of interfitted tubes positioned by quick-clamping fixtures (22) vulcanized onto the base.

4. A water trampoline according to claim 3 wherein the tubes defining the support frame (14) are mitered at each corner.

5. A water trampoline according to claim 1 wherein resilient means (26, 28) extend from the legs of the support frame (16, 18, 20) to provide an elastic attachment of the jumping covering (24) thereto.

6. A water trampoline according to claim 5 wherein the inner surface of the legs of the support frame (16, 18, 20) includes wave-like retaining means (30) for one end of the resilient elements (26, 28).

7. A water trampoline according to claim 1 wherein the cushioned platform (38) includes two air cushions (40, 42) of different lengths stacked to form a step, and wherein one portion of the lowermost air cushion (40) extends beyond the companion portion of the uppermost cushion to define a step therebetween.

8. A water trampoline according to claim 7 wherein the two air cushions are separately inflatable and are vulcanized together and fixed on the support frame leg (18) on the respective leg (36) of the base (12).

9. A water trampoline according to claim 1 wherein handles (54) and steps (56) are positioned on the outer walls of the base (12) adjacent the cushioned platform (38).

10. A water trampoline according to claim 9 wherein the handles (54) and steps (56) include a plate-shaped portion (58) mounted on the base (12) and extending into the water.

* * * * *